US006606924B2

(12) United States Patent
Chandler et al.

(10) Patent No.: US 6,606,924 B2
(45) Date of Patent: Aug. 19, 2003

(54) FASTENER STARTER TOOL

(75) Inventors: Faith T. Chandler, Titusville, FL (US); William D. Valentino, Oviedo, FL (US); Harry L. Garton, Merritt Island, FL (US); Michael C. Arnett, Mims, FL (US)

(73) Assignee: The Boeing Company, Seattle, WA (US)

( * ) Notice: Subject to any disclaimer, the term of this patent is extended or adjusted under 35 U.S.C. 154(b) by 58 days.

(21) Appl. No.: 09/974,998

(22) Filed: Oct. 10, 2001

(65) Prior Publication Data

US 2002/0050190 A1 May 2, 2002

Related U.S. Application Data

(60) Provisional application No. 60/245,258, filed on Oct. 31, 2000.

(51) Int. Cl.[7] ..... B25B 13/28

(52) U.S. Cl. ..... 81/90.2; 81/125; 81/467; 279/46.1

(58) Field of Search ..... 81/90.2, 10, 112, 81/113, 115, 114, 90.3, 90.9, 125, DIG. 6, 451, 452, 467, 453, 448, 471, 455, 438; 279/46.1, 50, 51, 107, 310, 312

(56) References Cited

U.S. PATENT DOCUMENTS

| | | | | | |
|---|---|---|---|---|---|
| 880,646 | A | * | 3/1908 | Fleckenstien | 279/46.1 |
| 2,320,967 | A | * | 6/1943 | Dunkelberger | 294/100 |
| 2,502,025 | A | * | 3/1950 | Raup | 81/125 |
| 2,620,001 | A | | 12/1952 | Fratz et al. | |
| 2,704,954 | A | * | 3/1955 | Martorella | 81/112 |
| 2,798,394 | A | | 7/1957 | Hubbard | |
| 3,210,836 | A | * | 10/1965 | Johanson et al. | 29/278 |
| 3,373,639 | A | * | 3/1968 | Van Dale et al. | 81/112 |
| 3,379,231 | A | | 4/1968 | Gallo, Sr. | |
| 4,757,729 | A | * | 7/1988 | Martinmaas | 81/90.2 |
| 5,048,381 | A | * | 9/1991 | Allen et al. | 81/477 |
| 5,213,015 | A | * | 5/1993 | Disston, Jr. | 81/90.9 |
| 5,279,188 | A | * | 1/1994 | Seeger et al. | 81/64 |
| 5,343,786 | A | * | 9/1994 | Wridt | 81/438 |
| 5,988,023 | A | * | 11/1999 | Townsend et al. | 81/90.2 |
| 6,308,598 | B1 | * | 10/2001 | O'Neil | 81/467 |

FOREIGN PATENT DOCUMENTS

| | | |
|---|---|---|
| DE | 22 31 949 A | 2/1973 |
| GB | 619794 | 3/1949 |

OTHER PUBLICATIONS international search report.

(List continued on next page.)

*Primary Examiner*—Joseph J. Hail, III
*Assistant Examiner*—Hadi Shakeri
(74) *Attorney, Agent, or Firm*—DiPinto & Shimokaji, P.C.

(57) ABSTRACT

A fastener starter tool includes a number of spring retention fingers for retaining a small part, or combination of parts. The tool has an inner housing, which holds the spring retention fingers, a hand grip, and an outer housing configured to slide over the inner housing and the spring retention fingers toward and away from the hand grip, exposing and opening, or respectively, covering and closing, the spring retention fingers. By sliding the outer housing toward (away from) the hand grip, a part can be released from (retained by) the tool. The tool may include replaceable inserts, for retaining parts, such as screws, and configured to limit the torque applied to the part, to prevent cross threading. The inner housing has means to transfer torque from the hand grip to the insert. The tool may include replaceable bits, the inner housing having means for transferring torque to the replaceable bit.

22 Claims, 6 Drawing Sheets

OTHER PUBLICATIONS

Mason, "Screw Starter Apparatus", research disclose, publications, Hampshire, GB, No. 298, Feb. 1, 1989, p. 138 XP000037838, ISSN: 0374–4353.
*5 Piece Specialty Tool Kit*—date unknown.
*Craftsman Flexible Pick–up Tool*—date unknown.
*Craftsman Flexible Pickup Tool w/Spring Jaws*—date unknown.
*Craftsman Screw–holding Drivers*—date unknown.
*General Adjustable Pin Vise*—date unknown.
*Leibinger Ergonomic Instruments*—date unknown.
*Leibinger Hardware Box*—date unknown.
*Ratchet Handle Screwdriver*—date unknown.
*Screw Starter*—date unknown.
*Sears Craftsman 6–pc Screw Stabilizer Kit*—date unknown.

* cited by examiner

FASTENER STARTER TOOL

CROSS-REFERENCE TO RELATED APPLICATIONS

The present application claims the benefit of U.S. Provisional Application No. 60/245,258, filed Oct. 31, 2000.

GOVERNMENT RIGHTS

The invention described herein was made in the performance of work under NASA Contract No. NAS10-11400 and is subject to the provisions of Section 305 of the National Aeronautics and Space Act of 1958 (72 Stat. 435: 42 U.S.C. 2457.)

BACKGROUND OF THE INVENTION

The present invention generally relates to tools for preventing the unintentional dropping of machine parts and, more particularly, to a fastener starter tool and a related method for starting the installation of fasteners without dropping fastener parts.

A basic problem that occurs during installation and removal of small hardware parts (e.g., screws, washers, nuts, bolts, spacers, etc) is the accidental, or unintentional, dropping of the small hardware parts, which may become lost. The problem of dropping small parts appears to occur more frequently when small parts are installed by hand. This problem may occur in all facets of aviation and aerospace processing, including commercial aviation, where there may be a high potential for small parts to be dropped during installation and removal inside flight hardware. If small parts are dropped within or in close proximity to elements of flight hardware, the small parts may not be recoverable, thereby increasing the probability of damage to the flight hardware during processing or flight. For example, damage may be produced as a result of lost and unrecovered small parts becoming projectiles.

In the space program, such lost and unrecovered small parts contribute to a problem referred to as "foreign object debris." For example, in the space program, the lost and unrecovered small parts, or foreign object debris, may damage the spacecraft and produce catastrophic consequences including loss of mission, crew, and spacecraft. Because of safety concerns arising out of the problem of foreign object debris, delays may occur to search for missing parts, and collateral damage may occur when retrieving parts. In the space program, significant amounts of time may be spent in locating lost or dropped parts that impacts schedules and continues to cause problems for spacecraft processing. The problem of damage from foreign object debris may occur in all facets of aviation and aerospace processing, including commercial aviation where a significant percentage of in-flight incidents have been attributed to loss of small parts. Thus, prevention of foreign object debris is crucial, and the reduction of dropped parts is a critical element in the prevention of foreign object debris.

No satisfactory method or tool has existed to prevent dropping small hardware parts. Although methods to catch small parts, i.e., nets, have been developed, they are not completely effective in preventing foreign object debris. Some other prior techniques to prevent small parts from being dropped during installation include placing a thick lubricant or sticky substance in a socket to hold bolts or nuts. Some currently used devices include screw starters designed to hold a flat or Phillips head screw and, in some cases, a screw and washer. No other devices or methods currently exist to firmly hold, regardless of orientation, a single washer, spacer, bolt, nut, or combination of these parts and prevent the loss of the part or combination of parts during installation.

Furthermore, there are some constraints and requirements that are unique to the processing of space flight hardware. For example, a tool is needed that has the capability to be cleaned so that it is acceptable for use in a clean room environment. A reliable tool is needed that is non-shatterable and does not create foreign object debris, i.e., shard or exfoliation particles, during use. A tool is needed that does not have any magnetic properties, produce electrostatic discharge, or off-gas. A tool is needed that may be used in areas where fire or explosion hazards exist. A tool is needed that is not constructed from nor contains materials such as cadmium, zinc, mercury, rubber, or foam. A tool is needed that is designed to accommodate cramped spaces and can be used for blind installations and long reaches.

One tool, which addresses some of these problems, is the Craftsman® screw starter, which can be purchased in various sizes. The tool is listed in Sears Craftsman® magazine, year 2000, pg. 166: Catalog #9-41123, ⅛"×4", 0.1 lbs; Catalog #9-41124, 3⁄16"×5", 0.2 lbs; Catalog #9-41362, #1×4", 0.1 lbs; and Catalog #9-41363, #2×5", 0.2 lbs. This tool only accommodates screws and screw-washer combinations. It does not hold a variety of parts such as spacers, nuts, or combinations of parts during installation. It does not have a mechanism that prevents cross threading. It has a magnetic end. The handle length prevents use in cramped spaces. Additionally, the balance and length of the tool makes it difficult to use in blind installations.

A tool designed to hold screws is a screw starter manufactured by the Snap-On Tools® company. This screw starter is made in three different flat-tip screw sizes and three different Phillips head screw sizes. Three examples are the INSDHP50 Phillips tip screw starter, the INSDHP61 Phillips tip screw starter, and the INSDHP72 Phillips tip screw starter. This tool holds a screw by using a spring-loaded steel bit grip slot that is inserted into the top of the screw. This tool can be used only for flat head and Phillips head screws. It does not hold a variety of parts such as hex head screws, bolts, washers, spacers, or nuts. This tool may be difficult and frustrating to use. Additionally, this tool may break easily, and its broken parts have the potential to become foreign object debris. This tool has no mechanism to prevent cross-threading. Additionally, this tool has a standard handle length, which does not accommodate cramped or hard to reach spaces.

Another tool that may be used as a screw starter is screwdriver 62-125000, produced by Stryker Leibinger. This specialized screw starter was developed specifically for reconstructive surgery and is used to place screws in bones. This tool has spring fingers that grasp a screw and hold it during installation, and a housing that is moved to release the screw after it has been tightened down. This tool is designed for clean room environments. However, it is not designed to hold screws larger than 2.3 mm, or a variety of parts such as washers, bolts, nuts, or spacers. This tool has one handle size, and will not accommodate blind installations and long reaches.

The need for reduction of foreign object debris in the space program, and in particular for space shuttle processing, has intensified the need for a reliable and sturdy tool that can accommodate a variety of parts, for example, screws, nuts, and spacers, and a variety of part sizes, and hold them securely during their installation in order to prevent the dropping of small parts.

As can be seen, there is a need for a fastener starter tool that accommodates a variety of small part types and sizes and securely holds the small parts, regardless of orientation, during installation and removal. Furthermore, there is a need for a fastener starter tool that is reliable, i.e. does not easily break or shatter, so as not to produce foreign object debris from the tool itself. There is also a need for a fastener starter tool that may be used in cramped spaces and is not difficult to operate. Moreover, there is a need for a fastener starter tool that is not magnetic and is constructed from materials that are acceptable for clean room environments.

SUMMARY OF THE INVENTION

The present invention provides a fastener starter tool that accommodates a variety of small part types and sizes and securely holds the small parts, regardless of orientation, during installation and removal. The present invention further provides a fastener starter tool that is reliable in order to prevent the tool from contributing to foreign object debris. The present invention also provides a fastener starter tool that is not difficult to operate and may be used in cramped spaces. Moreover, the present invention provides a fastener starter tool that is not magnetic and is constructed from materials that are acceptable for clean room environments.

In one aspect of the present invention, a fastener starter tool includes a number of spring retention fingers capable of retaining a small fastener part or other object. The fastener starter tool has an inner housing with one end adapted for a hand grip. The inner housing securely holds the spring retention fingers, for example, by holding the ends of the fingers in a slot. The fastener starter tool has an outer housing configured to slide over the inner housing and over the spring retention fingers toward the hand grip end and away from the hand grip end of the inner housing, so that the spring retention fingers are exposed and opened and, respectively, covered and closed. Thus, by sliding the outer housing toward the hand grip end, an object can be released from the fastener starter tool, and by sliding the outer housing away from the hand grip end an object can be retained by the fastener starter tool.

In another aspect of the present invention, a fastener starter tool includes a number of spring retention fingers, each having a hook on one end angled approximately 90 degrees to the body of each spring retention finger, the hook being capable of retaining a small fastener part or other object. The fastener starter tool has an inner housing with one end adapted for a hand grip. The inner housing securely holds the spring retention fingers aligned along the inner housing, for example, by holding the other end from the hook end, i.e., attachment end, of each finger in a slot. The fastener starter tool has an outer housing configured to slide over the inner housing and over the spring retention fingers, as described above, so that an object can be released and retained using the fastener starter tool.

In another aspect of the present invention, a fastener starter tool includes a number of spring retention fingers, each having a hook on one end angled approximately 90 degrees to the body of each spring retention finger, the hook being capable of retaining a small fastener part or other object. The fastener starter tool has an inner housing with a hand grip either attached or formed at one end. The hand grip may include a standard size drive attachment receptacle for connection to, for example, a ratchet wrench, drive handle, or other standard size drive attachment. The inner housing securely holds the spring retention fingers aligned along the inner housing, for example, by holding the other end from the hook end, i.e., attachment end, of each finger in a slot. The fastener starter tool has an outer housing configured to slide over the inner housing and over the spring retention fingers, as described above, so that an object can be released and retained using the fastener starter tool. The fastener starter tool further includes a replaceable elastomeric material insert, sized to retain an object, such as a screw fastener, and configured to limit the torque applied to that object. The inner housing may have slots for raised bosses on the insert, so that torque may be transferred from the hand grip to the inner housing to the insert, and thereby to the object in a limited manner. The fastener starter tool also may include a replaceable bit, the inner housing having a means, such as a hex shaped receptacle fitted to a hex shaped bit, for applying torque to the replaceable bit.

In another aspect of the present invention, a method includes the steps of gripping a hand grip of a fastener starter tool; then, pulling an outer housing of the fastener starter tool toward the hand grip so as to expose and open the spring retention fingers of the fastener starter tool; then, placing an object into the insert of the fastener starter tool; then, pushing the outer housing of the fastener starter tool away from the hand grip so as to cover and close the spring retention fingers and retain the object; then, installing the object, for example, by turning the fastener starter tool retaining a screw fastener until the screw threads catch; and then, pulling the outer housing toward the hand grip so as to expose and open the spring retention fingers and release the object. The method may also include a step of holding the object on a bolt board before placing the object into the insert of the fastener starter tool, and a step of removing the object from the bolt board using the fastener starter tool after retaining the object.

These and other features, aspects and advantages of the present invention will become better understood with reference to the following drawings, description and claims.

DETAILED DESCRIPTION OF THE INVENTION

Figure 1A:
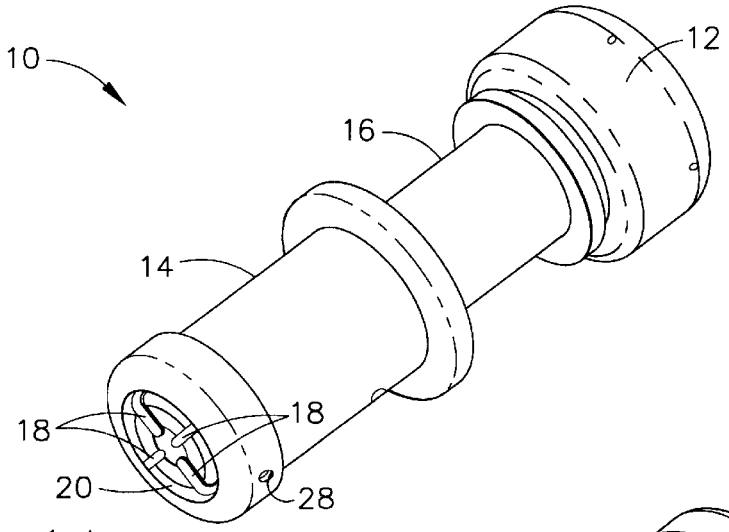
FIG. 1A is an isometric view of a completely assembled fastener starter tool according to one embodiment of the present invention.

The following detailed description is of the best currently contemplated mode of carrying out the invention. The description is not to be taken in a limiting sense, but is made merely for the purpose of illustrating the general principles of the invention, since the scope of the invention is best defined by the appended claims.

The present invention provides a fastener starter tool that accommodates a variety of small type fastener parts and sizes and securely holds the small parts, regardless of orientation, during installation and removal. The fastener starter tool is a small, lightweight, tool that firmly retains small parts and combinations of small parts, such as screws, bolts, washers, nuts, and other fasteners, to prevent dropping the small parts during their installation and removal. The fastener starter tool of the present invention is easily operated and may be used in cramped spaces. The fastener starter tool is ergonomically efficient with a retention and release mechanism that can be operated with one hand while supporting, or gripping, the tool with the same hand. The fastener starter tool is designed to enable technicians to install small parts with less chance of dropping them than if they were installed by hand or with other currently available tools. The fastener starter tool allows technicians to install parts in all orientations, in hard to access locations, in cramped locations, and can be used for blind installations and long reaches.

The fastener starter tool of the present invention is especially suited to use in space flight vehicles because it is reliable from the point of view of being non-shatterable, i.e. does not break into shards or exfoliate pieces of the tool on impact, and is substantially unbreakable during use, so that the tool is safe in regard to being highly unlikely to create or contribute to foreign object debris. The fastener starter also is especially suited to use in space flight vehicles because it does not have any magnetic properties, does not produce electrostatic discharge, and does not off-gas; it may be used in areas where fire or explosion hazards exist; it is constructed from materials that are acceptable for clean room environments; it is not constructed from nor does it contain materials such as cadmium, zinc, mercury, rubber, or foam. In addition to being especially suited to use in space flight vehicles, the fastener starter tool of the present invention is suited to use in all facets of aviation and aerospace processing, including commercial aviation, as well as any other industry where dropping hardware could be hazardous, such as the nuclear industry, electrical power plants, automotive manufacturing, and the construction industry. The fastener starter tool of the present invention may also be suited to use in the assembly and repair of items as diverse as household major appliances and automobiles, where the constraints on materials and properties of the tool can be relaxed from those imposed by the space program.

A primary advantage of the fastener starter tool of the present invention is that it securely grips the hardware, thereby preventing parts from being dropped and lost during installation. In contrast, prior art and other currently available starters can drop parts because of the inadequacy of their grip mechanisms and the awkwardness of the hardware connection. The fastener starter tool of the present invention can not only grip and hold a single fastener hardware part, such as a bolt, nut, washer, or spacer, but the fastener starter tool of the present invention also can grip and hold various multiple combinations of fastener hardware parts. By way of contrast, prior art and currently available fastener starters are only capable of gripping either a screw or a screw and washer. In the fastener starter tool of the present invention, parts are held using a replaceable insert, for example, made of elastomeric material such as urethane, that applies only a limited amount of torque to the part. If the part begins cross threading, the insert slips against the part, so that the torque applied to the part is insufficient to cross thread the part. Thus, the fastener starter tool of the present invention may be used to prevent cross threading. The fastener starter tool can be used without inserts to provide minimal torque. Additionally, optional bits may be inserted into the present fastener starter tool to allow hardware torquing. Prior art tools with the option to prevent cross threading have not been found.

In addition, by using replaceable inserts and bits, the present fastener starter tool can accommodate a range of part sizes and types as opposed to only one type or size of hardware. The present fastener starter tool also may incorporate the ability to use different handle types, by providing a standard quarter-inch drive receptacle, or other standard size receptacle, to provide different drives and reaches, for example, ratchet drives or long extensions may be fitted to the tool at the receptacle to change the leverage or reach of the tool. With the combination of replaceable inserts, bits, and handles the present fastener starter tool has the flexibility to do the job of many fastener starter tools, in contrast to the prior art, which generally provides one permanently attached handle, which makes the tool difficult to use in tight spaces and hard to reach locations, and does not provide inserts. The present fastener starter tool's method to firmly grip and release hardware without the use of magnetics, and its ability to accommodate a variety of part sizes, types and hardware combinations are attributes that, either alone or in combination, distinguish the present fastener starter tool from the prior art and currently available tools.

With regard to use in the space industry, the present fastener starter provides a level of reliability and foreign object debris safety that is not available in the prior art. The present fastener starter is compatible with clean room environments, is small—allowing access to areas with limited space—and easy to operate, and is non-magnetic, the combination of which has not been found in the prior art for a fastener starter tool which can securely hold a variety of part sizes, types and hardware combinations. Accordingly, the present fastener starter tool provides a solution to the problem of dropping and losing hardware—contributing to foreign object debris—that has plagued the Space Industry since its inception.

Figure 1B:
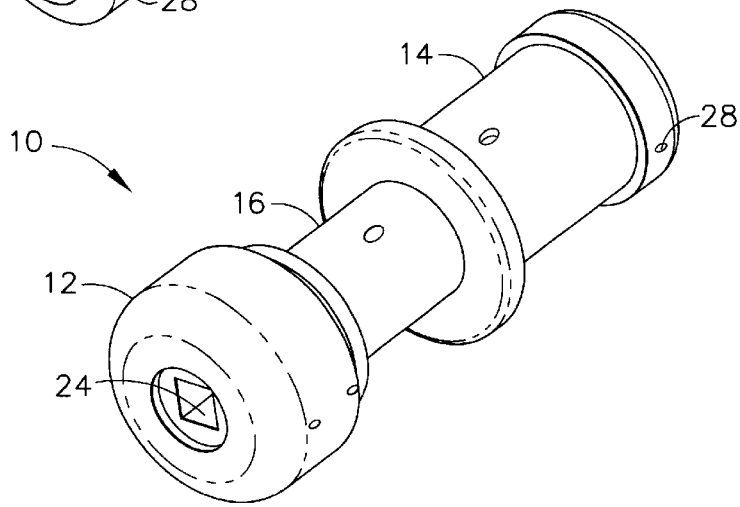
FIG. 1B is an isometric view, oriented 180 degrees from that seen in FIG. 1A, of a complete fastener starter tool according to one embodiment of the present invention.
Figure 1C:
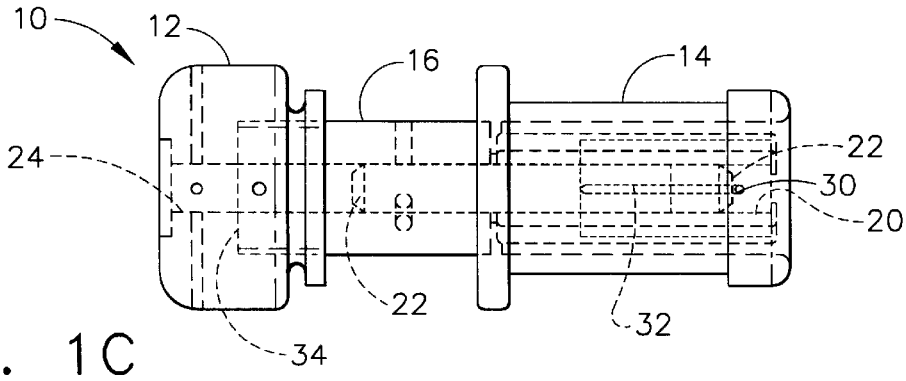
FIG. 1C is a side view (with interior contours shown by hidden lines) of a complete fastener starter tool according to one embodiment of the present invention.

Referring now to FIGS. 1A, 1B, and 1C, fastener starter tool 10 is shown according to one embodiment of the present invention. Fastener starter tool 10 comprises a hand grip 12, also referred to as an "upper collar", an outer housing 14, an inner housing 16, spring retention fingers 18, and an insert 20. Insert 20 can be removed easily and replaced with an optional screwdriver type or other type of tool bit 22 to enhance torquing as described above. Bit 22 is shown by hidden lines in FIG. 1C.

As seen in the embodiment shown in FIGS. 1A, 1B, and 1C, fastener starter tool 10 may use four spring retention fingers 18 to hold an object or part, for example, a screw or other type of fastener, in the tool. This allows fastener starter tool 10 to be used where magnetic type screw holders are not applicable. Fastener starter tool 10 employs either insert 20, which may be made of an elastomeric material, tool bit 22, neither, or both, installed in inner housing 16.

Outer housing 14 is sized to slide easily and smoothly over inner housing 16 and spring retention fingers 18. For example, in the embodiment illustrated in FIGS. 1A, 1B, and 1C, the maximum outside diameter of the cylinder forming inner housing 16 is approximately 0.683 inches and the minimum inside diameter 26 of the cylindrical opening of outer housing 14 is approximately 0.688 inches. In the example embodiment, the axial travel of outer housing 14 on inner housing 16 is guided by roll pins 28 which are set in holes 30 in outer housing 14. Other means for guiding inner housing 16 may be used in place of roll pins 28, such as dowel pins or dog point set screws, for example. Roll pins 28 project inward from outer housing 14 into slots 32 in inner housing 16. Slots 32 thereby limit the back and forth axial travel of outer housing 14 toward and away from hand grip end 34 of inner housing 16 and hand grip 12 by roll pins 28 riding in slots 32. Roll pins 28 projecting inward from outer housing 14 into slots 32 in inner housing 16 also prevent outer housing 14 from becoming disassembled from inner housing 16 and starter fastener tool 10. In other embodiments, the functions of guiding and limiting axial travel and preventing disassembly may be performed by means other than roll pins 28 riding in slots 32, for example, by lips or stops (not shown in any of the figures) on inner housing 16.

When outer housing 14 is moved toward hand grip end 34 and hand grip 12, spring retention fingers 18 are exposed and opened to their free state form allowing them to release an object or small part or to be moved into position for retaining an object or small part. When outer housing 14 is moved away from hand grip end 34 and hand grip 12, spring retention fingers 18 are covered and closed allowing them to retain an object or small part within insert 20 or against bit 22. Spring retention fingers 18 could also possibly retain an object or small part within inner housing 16 when no insert 20 or bit 22 is present, as in the case of using fastener starter tool 10 to merely retrieve an object from a relatively inaccessible location.

The use of insert 20 without a tool bit 22 allows for slippage of the screw if thread engagement into a tapped hole or nut is started incorrectly, i.e. begins cross threading. The slippage then prevents cross threading, and possible destruction of the screw or tapped hole. When using insert 20 with an opening on end 51 and in conjunction with tool bit 22, insert 20 may act as a centering and torquing device for the fastener.

Insert 20 may fabricated from an elastomeric material that holds parts snugly during their installation but allows parts to rotate within the tool to prevent cross threading, as described above. Insert 20 may be removed and bits 22 may be inserted into fastener starter tool 10, to create a fastener starter tool that installs and tightens hardware. When bits are inserted into the device, the tool can be used to tighten down screws. A drive handle, for example, commercially available quarter-inch drive handles in the embodiment illustrated in FIGS. 1A, 1B, and 1C, may be attached at drive receptacle 24, which may be a one quarter inch square tool cut-out, to provide a variety of handle sizes and additional length and leverage where needed. Fastener starter tool 10 may be used by itself, i.e. turned by hand, to access cramped areas, or used with a ratchet or other quarter-inch drive handle or extension inserted in drive receptacle 24. A quarter-inch drive is used to illustrate the example of the embodiment shown in FIGS. 1A, 1B, and 1C, but other standard drive sizes, such as three-eighths, could also be used. In addition, fastener starter tool 10 itself may be fabricated in different sizes, depending on the size of fasteners it is intended to be used with, thus necessitating the use of standard drive sizes other than quarter-inch drive.

The embodiment of fastener starter tool 10 shown in FIGS. 1A, 1B, and 1C, and described above, is intended for a 9–11 mm (millimeter) screw or bolt head and corresponding hardware. Modifications to the diameter of inner housing 16, outer housing 14, and insert 20 will accommodate additional screw sizes. Variations in the depth of insert 20 will accommodate various combinations of hardware, for example, a screw and washer combination, or a screw, washer and spacer combination. Additional outer housing 14 and inner housing 16 of the fastener starter tool can be extended or shortened to accommodate unique applications, for example, narrow access areas or recessed screws. As previously described, insert 20 can be easily removed and replaced with various commercially available drive bits 22, or specifically designed bits, to enable torquing or insert 20 can be made hollow, for example, to allow use of bit 22 and insert 20 simultaneously.

For use in the aerospace industry and the space program, upper collar or hand grip 12, outer housing 14, and inner housing 16 are preferably fabricated of 6061-T6 aluminum, which allows fastener starter 10 to be acceptable for clean room use, as well as meeting the other constraints and requirements described above. For less rigorous applications, the housings may be fabricated from other appropriate material, which may be a less expensive material or one more suited to the particular application. Spring retention fingers 18 are preferably cut and formed from flat stainless spring steel. Spring retention fingers 18 may also be formed from other spring material. Insert 20 is preferably fabricated from elastomeric material. To make the tool easier to turn by hand, outer housing 14 may have a textured (e.g., knurled) finish or other similar surface finish that extends across the entire surface of outer housing 14 from raised portion 42 to raised portion 44.

Figure 2A:
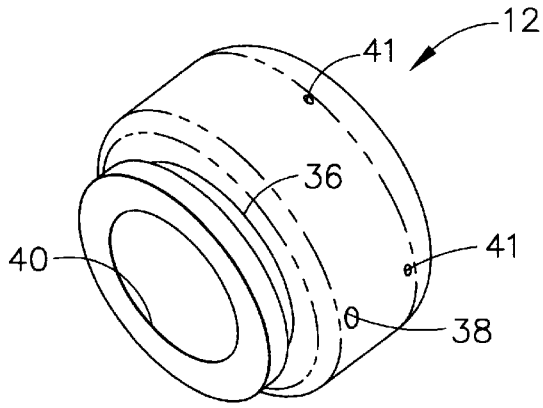
FIG. 2A is an isometric view of an upper collar, or hand grip, according to one embodiment of the present invention.
Figure 2B:
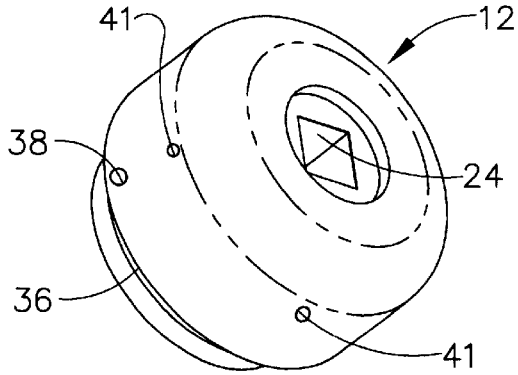
FIG. 2B is an isometric view, oriented 180 degrees from that seen in FIG. 2A, of an upper collar, or hand grip, according to one embodiment of the present invention.

Referring now to FIGS. 2A and 2B, "upper collar" or hand grip 12 is shown according to one embodiment of fastener starter tool 10. Hand grip 12 may be provided with drive receptacle 24 for attachment of commercially available, or other, drive handles, as described above.

Groove 36 in hand grip 12 may be provided to allow for a tethering cable to be attached to fastener starter tool 10. The tethering cable, which may be wire or other suitable cable material, is preferably attached so that the tool can be turned without binding on the cable. In applications outside the space industry, for example, automotive repair, groove 36 may be omitted from the design. Hand grip 12 may also have a textured (e.g., knurled) finish to make fastener starter tool 10 easier to turn by hand.

FIGS. 2A and 2B also show holes 38, which may be used to accommodate set screws or dowel pins or some other form of attaching hand grip 12 to inner housing 16. In one embodiment, inner diameter 40 should be appropriately dimensioned to fit snugly over hand grip end 34 of inner housing 16. In other embodiments, alternative means of attaching hand grip 12 and inner housing 16 may be used, and hand grip 12 may also be integrally formed with inner housing 16. Additionally recessed detents are created by crossed drilled holes 41 into hand grip 12 to provide a recessed hole for a spring ball on a standard locking type handle, socket wrench, ratchet wrench, or extension. In other embodiments, the recessed detent can be created by alternative means.

Figure 3:
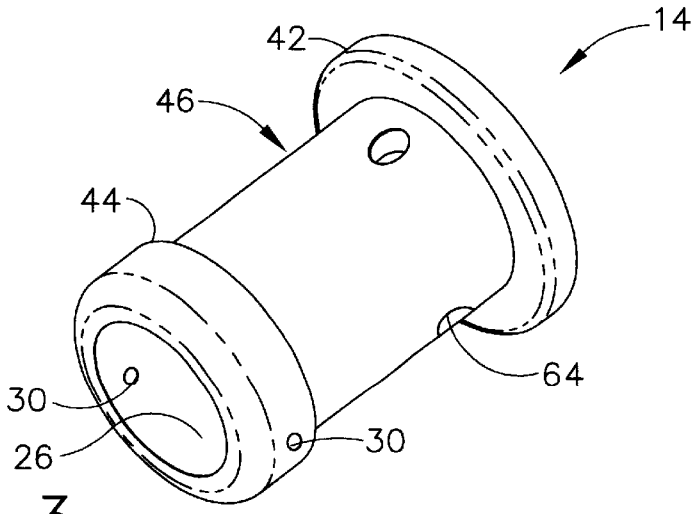
FIG. 3 is an isometric view of an outer housing according to one embodiment of the present invention.

Referring now to FIG. 3, outer housing 14 is shown according to one embodiment of fastener starter tool 10. As described above, inside diameter 26 should be dimensioned to slide easily and smoothly over inner housing 16 and spring retention fingers 18. Holes 30 may be provided to accommodate roll pins 28. Outer housing 14 may be provided with raised portions 42 and 44, also referred to as upper finger grip and lower finger grip, respectively, to provide a better grip for the user's fingers. Raised portions 42 and 44 and barrel 46 may also have a textured (e.g., knurled) finish to make fastener starter tool 10 easier to turn by hand.

Figure 4A:
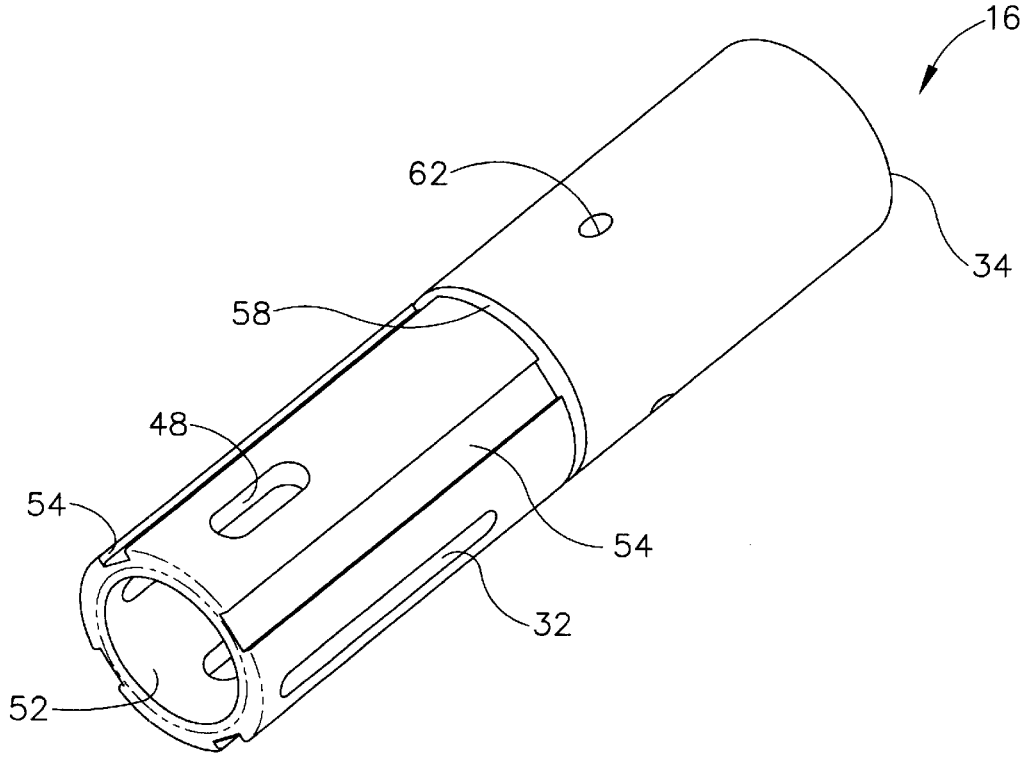
FIG. 4A is an isometric view of an inner housing according to one embodiment of the present invention.
Figure 4B:
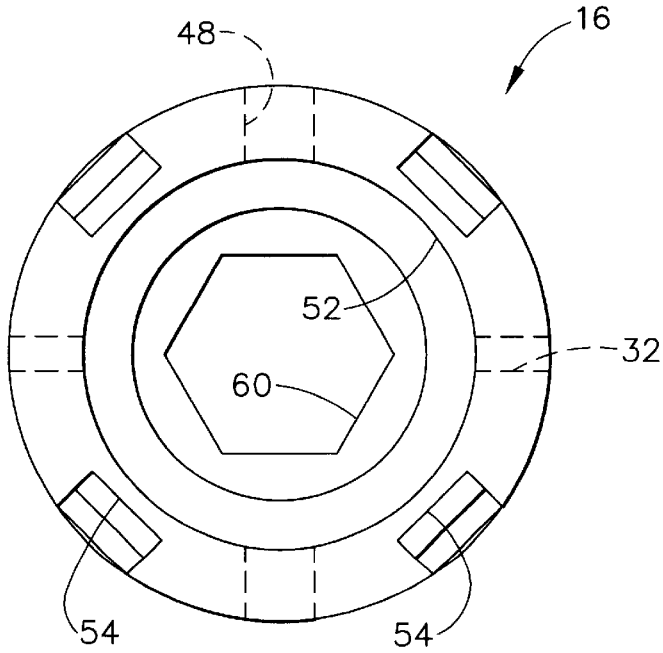
FIG. 4B is an end view, viewed from the left of FIG. 4A, of an inner housing according to one embodiment of the present invention.

Referring now to FIGS. 4A and 4B, inner housing 16 is shown according to one embodiment of fastener starter tool 10. As described above, inner housing 16 may be provided with slots 32 to accommodate roll pins 28, whereby functions of guiding and limiting travel and preventing disassembly of outer housing 14 may be performed. Inner housing 16 may also be provided with slots 48 for holding raised bosses 50 of insert 20, also referred to as "insert retention bosses", whereby inner housing 16 securely holds insert 20 and, as described above, inner housing 16 may transfer torque to insert 20. Inner housing 16 has cylindrical opening 52 for holding insert 20, and to which the outer diameter of insert 20 is sized to fit snugly into. The rear, or top, portion of cylindrical opening 52, closest to hand grip end 34, may be provided with a hex-shaped interior 60, as seen in FIG. 4B, as a means for holding and applying torque to optional replaceable tool bits 22. Inner housing 16 may also be provided with a threaded set screw hole 62, or ball detent, to provide a means for more securely holding bits 22. Outer housing 14 may be provided with access holes 64, seen in FIG. 3, which line up over set screw holes 62 when outer housing 14 is placed in the appropriate position over inner housing 16.

Inner housing 16 may also be provided with recesses 54 for aligning and retaining spring retention fingers 18 along the length of inner housing 16 and more securely holding spring retention fingers 18 to inner housing 16 by aligning the bodies 55 of spring retention fingers 18. Recesses 54 may also provide a recessed area for spring retention fingers 18 to retract into, in order to enable outer housing 14 to more smoothly slide back and forth over inner housing 16. In one embodiment, spring retention fingers 18 are attached to inner housing 16 by being held at an attachment end 56 of each spring retention finger 18. Attachment ends 56 are snugly held by groove 58, which may cut around the circumference of inner housing 16. Alternatively, a separate groove 58 may be provided for the attachment end 56 of each spring retention finger 18. Other means of attaching or holding spring retention fingers 18 to inner housing 16 may also be provided by other embodiments as will be apparent to a person of ordinary skill in the art.

Figure 5A:
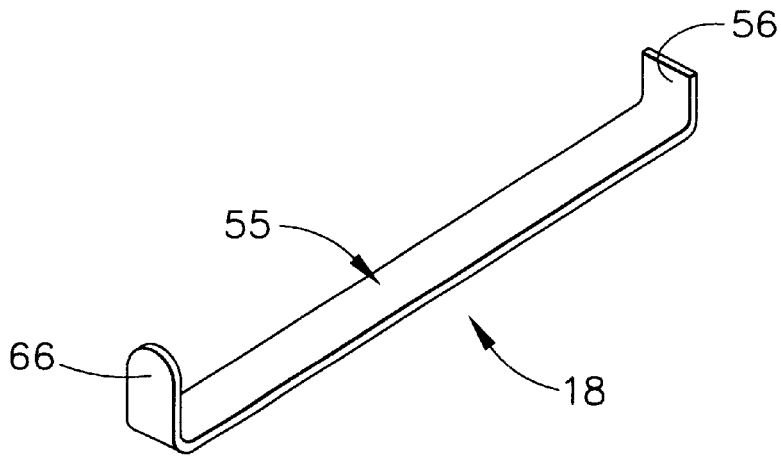
FIG. 5A is an isometric view of a spring retention finger, in its constrained configuration while assembled between the outer housing and inner housing, according to one embodiment of the present invention.
Figure 5B:
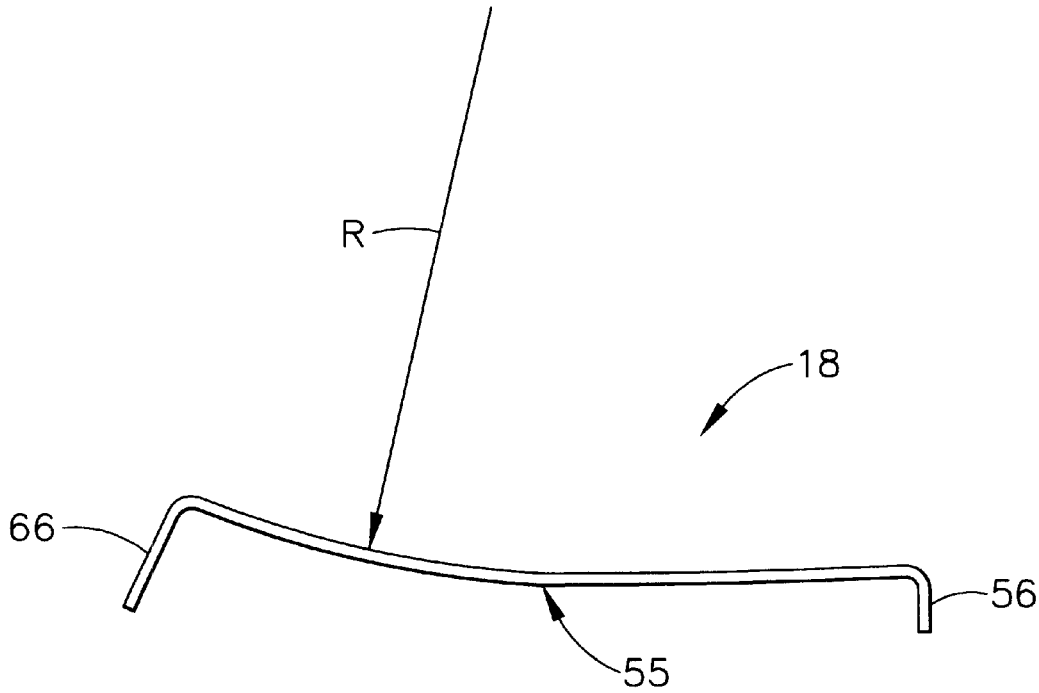
FIG. 5B is a side view of a spring retention finger, in its unconstrained configuration, according to one embodiment of the present invention.

Referring now to FIGS. 5A and 5B, a spring retention finger 18 is shown according to one embodiment of fastener starter tool 10. As described above, spring retention fingers 18 are preferably cut and formed from flat stainless spring steel, and may be formed from other spring material. In the embodiment shown in FIGS. 5A and 5B, spring retention finger 18 has an attachment end 56 angled approximately 90 degrees to body 55, and a hook end 66, also angled approximately 90 degrees to body 55 of spring retention finger 18. As described above, attachment end 56 is snugly held by groove 58. Body 55 retracts into recess 54 when spring retention finger 18 is covered by outer housing 14. FIG. 5A shows spring retention finger 18 in its flat configuration, for example, when covered by outer housing 14 and retracted into recess 54. FIG. 5B shows spring retention finger 18 in its open configuration, for example, when exposed by outer housing 14. As seen in FIG. 5B, spring retention finger 18 may be formed with a radius of curvature R, to which shape the spring is biased to return when exposed by outer housing 14.

Hook end 66 allows spring retention finger 18 to retain an object or small part within insert 20 or against bit 22, or possibly within fastener starter tool 10 used without a bit or insert, as described above. With regard to prevention of foreign object debris, all of the working parts of fastener starter tool 10 are contained within outer housing 14, except for hook ends 66 of spring retention fingers 18. A brace made of more ductile metal than spring steel may be added to hook ends 66 of spring retention fingers 18, so that if spring retention finger 18 fractures, hook end 66 will not separate from spring retention finger 18.

Figure 6:
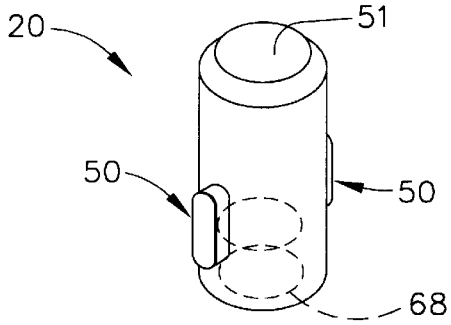
FIG. 6 is an isometric view of an insert, seen facing down, according to one embodiment of the present invention.

Referring now to FIG. 6, insert 20 is shown according to one embodiment of fastener starter tool 10. As described above, insert 20 is preferably fabricated from elastomeric material, such as castable liquid urethane, by casting in a mold. Other embodiments may be created from other elastomeric material and manufacturing methods. Insert 20 may be provided with raised bosses 50 for transmitting torque to insert 20 and for holding insert 20 securely in inner housing 16, as described above. Insert 20 may be provided with recess 68. The inner insert profile of recess 68 may be varied in size, shape, and depth depending on the type and size of small part which that particular insert 20 is intended to hold. Inserts 20, for example, may be provided in sets, one insert for holding screws, washers and spacers or combinations of screws, washers and spacers, another insert for holding nuts, and so forth. Insert 20 may include additional modifications at base 51 to provide variation in the means of insert installation and removal. For example, in one embodiment, an attach point could be incorporated at base 51 of insert 20 so that a threaded rod could be used to install and remove the insert.

Spring retention fingers 18 hold a small part or combination of small parts against insert 20 until the small parts are manually released. Accidental release of the small part is prevented by the grip pressure, which is applied by four spring retention fingers 18 in the example embodiment used for illustration. The grip pressure is sufficient to prevent a collision from dislodging a part. Insert 20 provides enough resistance to maintain the hold on a part, for example, a bolt or a screw, while the part is subjected to the minimal torque required to engage the threads on the bolt or screw. Insert 20 allows parts to rotate within insert 20 if the minimal torque is exceeded, to prevent cross threading, as described above.

In operation of fastener starter tool 10, when the user pulls outer housing 14 back toward hand grip 12, roll pin 28 attached to outer housing 14 slides down slot 32 on inner housing 16 until roll pin 28 reaches the end of slot 32 and stops movement of outer housing 14. As outer housing 14 is slid backward across inner housing 16, spring retention fingers 18 are exposed. Because spring retention fingers 18 are biased outward, spring retention fingers 18 open and expose recess 68 in insert 20. The open spring retention fingers 18 provide the user with access to insert 20, where the user places a screw, for example, or other hardware. The user then holds hand grip 12 with one hand and holds outer housing 14 with the other. The user pushes outer housing 14 away from hand grip 12 moving roll pins 28 along slot 32 until roll pins 28 reaches the end of slot 32 and stops movement of outer housing 14. As outer housing 14 is moved over inner housing 16, outer housing 14 closes and covers spring retention fingers 18, allowing spring retention fingers 18 to capture and firmly grasp the screw, or other hardware. The user then guides the end of the screw, or other hardware into its destination and turns the tool to install, or screw in, the screw, or other hardware. When the hardware is installed, again using only one hand, the user pulls back on outer housing 14, sliding outer housing 14 containing roll pins 28 along slot 32 to the end of slot 32, uncovering and opening spring retention fingers 18, allowing release of the screw, or other hardware. If the screw, or other hardware is not engaged, i.e. is not properly installed, pulling back on fastener starter tool 10 will not release the screw, or other hardware; but merely withdraws fastener starter 10 and the screw, or other hardware, from the installation, thus precluding premature release of the screw, or other hardware.

Figure 7:
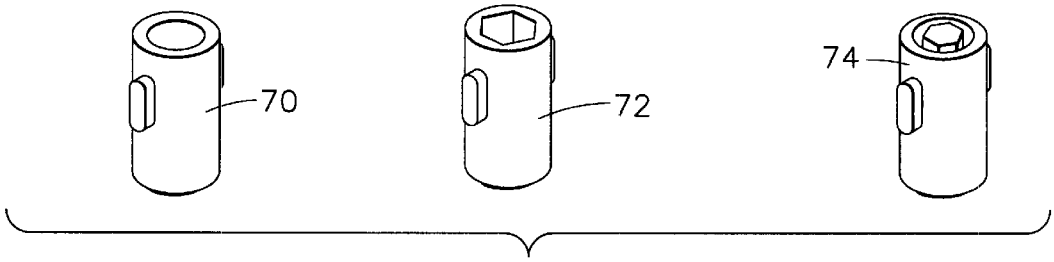
FIG. 7 is an isometric view of optional inserts, seen facing up, according to other embodiments of the present invention.

FIG. 7 shows some examples of optional replaceable inserts 20. Cylindrical insert 70, for example, may used as described above for bolts, screws, washers, spacers, or any appropriate combination of these. External hex insert 72, for example, may be used as described above for hex cap screws and bolts, nuts, and in appropriate combination with other parts such as spacers. Internal hex insert 74, for example, may be used as described above for socket head cap screws and hex bolts, and in appropriate combination with other parts such as spacers.

Figure 8:
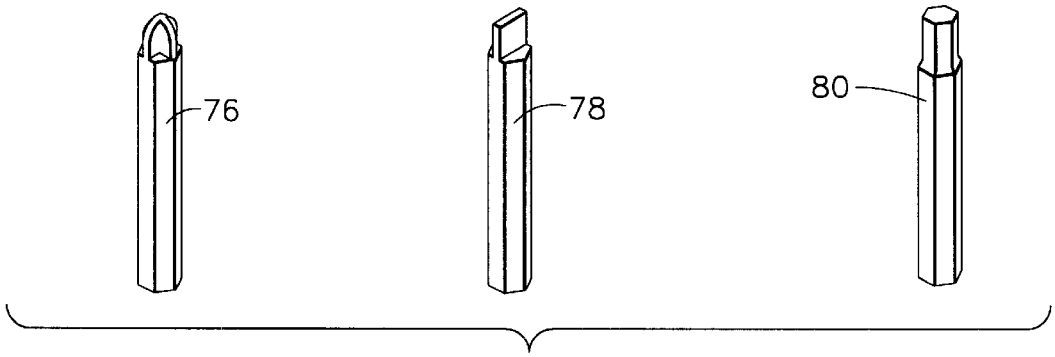
FIG. 8 (PRIOR ART)
FIG. 8 is an isometric view of optional tool bits according to other embodiments of the present invention.

FIG. 8 shows some examples of optional replaceable commercially available tool bits 22. Bit 76, for example, may used as described above for Phillips head screws, and in appropriate combination with insert 20 and other small parts appropriate for the particular insert 20 being used. Bit 78, for example, may used as described above for common or slot head screws, and in appropriate combination with insert 20 and other small parts appropriate for the particular insert 20 being used. Bit 80, for example, may be used as described above for socket head cap screws and bolts, and in appropriate combination with insert 20 and other small parts appropriate for the particular insert 20 being used.

An example illustrating a method for use of fastener starter tool 10 is as follows. The user holds hand grip 12 of fastener starter tool 10 in one hand. The user's other hand is used to pull outer housing 14 back toward hand grip 12, exposing spring retention fingers 18 and allowing them to open. The user places the hardware, for example, a combination of a screw and spacer, into insert 20. The user then holds hand grip 12 with one hand and holds outer housing 14 with the other hand. This can also be accomplished by holding hand grip 12 with palm and pulling back on outer housing 14 with fingers. The user pushes outer housing 14 away from hand grip 12, closing and covering spring retention fingers 18 and firmly grasping and retaining the hardware. The user then guides the end of the hardware into its destination and turns fastener starter tool 10 to install the hardware, for example, by screwing in the screw/spacer combination. When the hardware is installed, the user pulls back on outer housing 14, opening spring retention fingers 18 and releasing the hardware.

If the user requires leverage or an extension, the user can insert any commercially available, or other, quarter-inch drive accessory, in the present example used to illustrate one embodiment, into the quarter-inch drive receptacle 24 at the end of hand grip 12. The user can also attach a tether cable to fastener starter tool 10 by placing the tether connecting hardware in recessed groove 36 of hand grip 12.

Figure 9:
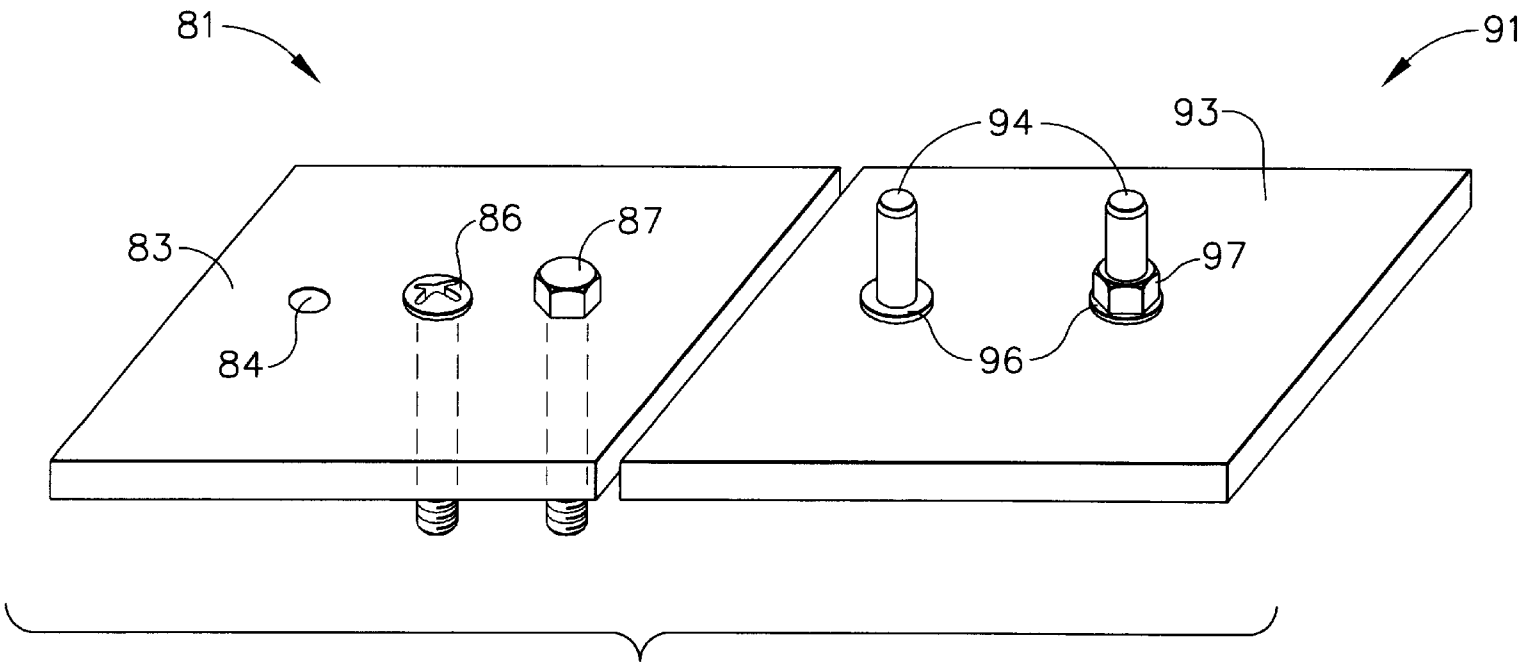
FIG. 9 (PRIOR ART)
FIG. 9 is an isometric view of an optional bolt board according to other embodiments of the present invention.

An alternative method for use of fastener starter tool 10 employs a drop-in bolt board 81 or a drop-in washer/nut holder 91, illustrative examples of which are shown in FIG. 9.

Drop-in bolt board 81 comprises plate 83 with holes 84 for holding individual screws 86 or bolts 87 vertically in a container (not shown) into which drop-in bolt board 81 may be placed. Drop-in bolt board 81 provides a place and sufficient space to store screws 86 and bolts 87 vertically, with the end going through plate 83 of drop-in bolt board 81 and extending beneath it, and the top of the screw 86 or bolt 87 lying flush on the surface of plate 83 of drop-in bolt board 81. The container may have a lid which fits snugly against the heads of the screws 86 and bolts 87 and holds them in place during transport.

Similarly, drop-in washer/nut holder 91 comprises plate 93 with vertical posts 94 for holding washers 96 or nuts 97, or other similar hardware, in a container (not shown) into which drop-in washer/nut holder 91 may be placed. Drop-in washer/nut holder 91 provides a place to store washers 96 or nuts 97, or other similar hardware, by placing them over vertical posts 94, where they may be stored either individually or stacked together, as seen in FIG. 9 where a first post 94 stores an individual washer 96 and a second post 94 stores a combination of a washer 96 and a nut 97. The container may have a lid which fits snugly against the tops of posts 94 and holds washers 96 and nuts 97, or other similar hardware, in place during transport.

A method for using fastener starter tool 10, employing either drop-in bolt board 81 or drop-in washer/nut holder 91 in conjunction with fastener starter tool 10, comprises the steps of the method for using fastener starter tool 10 described above. At the step where spring retention fingers 18 are open and the user is about to place the hardware into insert 20, the user, holding fastener starter tool 10 by outer housing 14, places the open hook ends 66 of spring retention fingers 18 over the head of screw 86 or bolt 87, for example, or over individual washer 96 or over the combination of washer 96 and nut 97, and places the hardware into insert 20 by pushing down on outer housing 14, picking up the hardware. The method then continues as described above as the user then holds hand grip 12 with one hand and holds outer housing 14 with the other hand or holds hand grip 12 within palm and pulls outer housing 14 back with fingers. The user pushes outer housing 14 away from hand grip 12, closing and covering spring retention fingers 18 and firmly grasping and retaining the hardware.

Using this method, the hardware can be retained by fastener starter tool 10 without handling it directly, i.e. without touching it with the user's hands. By eliminating unnecessary contact of the hardware by the user, dropping and loss of small parts, from the time they are removed from the container until they are installed in flight hardware, may be significantly reduced using this method. Thus, prevention of foreign object debris may be further enhanced using this method.

The present invention provides a fastener starter tool that complies with the many rigorous needs of the space program. In addition, the fastener starter tool of the present invention provides several distinct advantages over the prior art, for example, the ability to hold combinations of multiple fastener hardware pieces, the flexibility provided by different size replaceable inserts and bits, and the ability to prevent cross-threading, which are useful for fastener starter tools that are to be used in more ordinary applications.

It should be understood, of course, that the foregoing relates to preferred embodiments of the invention and that modifications may be made without departing from the spirit and scope of the invention as set forth in the following claims.

We claim:

1. A tool comprising:

a spring retention finger having a body and a means for retaining an object;

a roll pin;

an inner housing having a hand grip end, said inner housing having an annular groove that securely holds said spring retention finger to said inner housing, having a longitudinal recess extending along a length of said inner housing, wherein said body of said spring retention finger retracts into said recess, having a slot that accommodates said roll pin wherein said roll pin rides in said slot, and having a cylindrical opening sized to receive said object; and an outer housing configured to slide over said inner housing and over said spring retention finger toward said hand grip end and away from said hand grip end, said roll pin attached to said outer housing and said roll pin projecting inward from said outer housing into said slot of said inner housing, whereby said spring retention finger is exposed and opened and, respectively, covered and closed, so as to release said object and retain said object.

2. The tool of claim 1, further comprising a hand grip at said hand grip end of said inner housing and a raised portion on said outer housing that enables one hand operation.

3. The tool of claim 1, wherein said means for retaining an object comprises a hook end of said spring retention finger angled approximately 90 degrees to a body of said spring retention finger.

4. The tool of claim 1, wherein:

a said groove holds an attachment end of said spring retention finger angled approximately 90 degrees to said body of said spring retention finger; and a said recess aligns said body of said spring retention finger.

5. The tool of claim 1, further comprising an insert sized to retain said object, wherein said inner housing has means for applying torque to said insert and wherein said insert is configured to limit the torque applied to said object.

6. The tool of claim 5, wherein said insert is fabricated from an elastomeric material.

7. The tool of claim 6, wherein said elastomeric material is urethane.

8. The tool of claim 1, further comprising a bit and wherein said inner housing has means for applying torque to said bit.

9. The tool of claim 2, wherein said hand grip includes a standard size drive attachment receptacle.

10. The tool of claim 1, wherein said spring retention finger is cut and formed from flat stainless spring steel.

11. The tool of claim 1, wherein said hand grip, said outer housing, and said inner housing are fabricated from 6061-T6 aluminum.

12. A tool comprising:

a spring retention finger having a hook end angled approximately 90 degrees to a body of said spring retention finger for retaining an object, said spring retention finger also having an attachment end;

a roll pin;

a replaceable elastomer insert sized to retain said object and configured to limit a torque applied to said object;

an inner housing having a hand grip end and an annular groove, said spring retention finger being securely held by said groove to said inner housing at said attachment end of said spring retention finger, said inner housing having a longitudinal recess extending along a length of said inner housing, wherein said body of said spring retention finger retracts into said recess and said body of said spring retention finger is aligned to said inner housing, said inner housing having a first slot that accommodates said roll pin wherein said roll pin rides in said first slot; and said inner housing having a second slot and a cylindrical opening, wherein said insert fits into said cylindrical opening and said second slot holds a raised boss on said insert; and an outer housing configured to slide over said inner housing and over said spring retention finger toward said hand grip end and away from said hand grip end, said roll pin attached to said outer housing and said roll pin projecting inward from said outer housing into said first slot of said inner housing, whereby said spring retention finger is exposed and opened and, respectively, covered and closed, so as to release said object and retain said object.

13. The tool of claim 12, further comprising a hand grip attached at said hand grip end of said inner housing and a raised portion on said outer housing that enables one hand operation.

14. The tool of claim 13, wherein said hand grip includes a standard size drive attachment receptacle.

15. The tool of claim 12, wherein said torque is transferred from said inner housing to said insert via said second slot and said raised boss.

16. The tool of claim 15, wherein said insert is fabricated from elastomeric material.

17. The tool of claim 12, further comprising a bit and wherein said inner housing has means for applying torque to said bit.

18. The tool of claim 12, wherein said spring retention finger is cut and formed from flat stainless spring steel.

19. The tool of claim 12, wherein said hand grip, said outer housing, and said inner housing are fabricated from 6061-T6 aluminum.

20. A tool comprising:

a spring retention finger having a hook end angled approximately 90 degrees to a body of said spring retention finger for retaining an object, said spring retention finger also having an attachment end;

a roll pin;

an inner housing having a hand grip end and an annular groove, said spring retention finger being securely held by said groove to said inner housing at said attachment end of said spring retention finger, said inner housing having a longitudinal recess extending along a length of said inner housing, wherein said body of said spring retention finger retracts into said recess and said body of said spring retention finger is aligned to said inner housing, said inner housing having a first slot that accommodates said roll pin wherein said roll pin rides in said first slot; and said inner housing having a second slot and a cylindrical opening, a top portion of said cylindrical opening being provided with a hex-shaped interior;

a hand grip at said hand grip end of said inner housing, said hand grip including a standard size drive attachment receptacle;

an outer housing configured to slide over said inner housing and over said spring retention finger toward said hand grip end and away from said hand grip end, said roll pin attached to said outer housing and said roll pin projecting inward from said outer housing into said first slot of said inner housing, whereby said spring retention finger is exposed and opened and, respectively, covered and closed, so as to release said object and retain said object;

a replaceable elastomeric material insert sized to retain said object and configured to limit the torque applied to said object, wherein said insert fits into said cylindrical opening of said inner housing and said second slot of said inner housing holds a raised boss on said insert whereby torque is transferred from said inner housing to said insert; and a replaceable bit, wherein said hex-shaped interior of said cylindrical opening of said inner housing holds said bit.

21. A method comprising:

gripping a hand grip of a fastener starter tool;

pulling an outer housing of said fastener starter tool toward said hand grip and over an inner housing guided by a roll pin attached to said outer housing and riding in a slot in said inner housing so as to expose and open at least one spring retention finger securely held by an annular groove in said inner housing;

placing an object into an insert of said fastener starter tool;

pushing said outer housing of said fastener starter tool away from said hand grip so as to cover and close said at least one spring retention finger and retract a body of said at least one retention finger into a longitudinal recess in said inner housing and retain said object;

installing said object; and pulling said outer housing of said fastener starter tool toward said hand grip so as to expose and open said at least one spring retention finger and release said object.

22. The method of claim 21, further including a step of holding said object on a bolt board before said placing step, and a step of removing said object from said bolt board using said fastener starter tool after said pushing step.

* * * * *